United States Patent [19]

Tanimoto et al.

[11] Patent Number: 4,785,328

[45] Date of Patent: Nov. 15, 1988

[54] ELECTROPHOTOGRAPHIC COPYING MACHINE

[75] Inventors: Yoshiyuki Tanimoto, Tokyo; Mutsuo Watanabe; Takashi Murofushi, both of Yokohama, all of Japan

[73] Assignee: Ricoh Company, Ltd., Tokyo, Japan

[21] Appl. No.: 946,080

[22] Filed: Dec. 24, 1986

[30] Foreign Application Priority Data

| | | | |
|---|---|---|---|
| Dec. 27, 1985 | [JP] | Japan | 60-295790 |
| Feb. 5, 1986 | [JP] | Japan | 61-021899 |
| May 13, 1986 | [JP] | Japan | 61-107582 |
| May 20, 1986 | [JP] | Japan | 61-115647 |
| Jun. 19, 1986 | [JP] | Japan | 61-143764 |

[51] Int. Cl.[4] ..... G03G 15/00

[52] U.S. Cl. ..... 355/14 R; 355/14 E; 355/67; 355/69

[58] Field of Search ..... 355/11, 14 E, 14 R, 355/67–69; 340/600, 641, 642, 654; 324/452, 457, 458; 250/234–236, 578

[56] References Cited

U.S. PATENT DOCUMENTS

| | | | |
|---|---|---|---|
| 3,679,306 | 7/1972 | DuBois et al. | 355/14 E X |
| 4,095,890 | 6/1978 | Van Herten | 355/69 X |
| 4,235,550 | 11/1980 | Case | 355/14 R |

*Primary Examiner*—Patrick R. Salce
*Assistant Examiner*—Emanuel Todd Voeltz
*Attorney, Agent, or Firm*—Oblon, Fisher, Spivak, McClelland, & Maier

[57] ABSTRACT

An electrophotographic copying machine has a flash lamp for applying a flash of light to a document to be copied. The copying machine also includes a sensor for detecting whether the flash lamp is energized or not. When there is no signal indicating that the flash lamp is energized even in the presence of a command to energize the flash lamp, a control circuit determines that the flash lamp has failed to emit light at a predetermined exposure timing, and produces an output signal to effect a predetermined operation upon non-energization of the flash lamp. An arrangement for effecting such a predetermined operation may for example be a switch of an erase lamp, a control circuit for controlling operation of a copy counter, a switch of a motor for driving image developing rollers, a control circuit for controlling a developing bias, a switch of an image transfer charger, a control circuit for controlling a separator finger for changing feed paths of travel of an image transfer sheet, a control circuit for controlling a shutter to cover an image transfer charger, or a switch for driving rollers which feed an image transfer sheet.

20 Claims, 9 Drawing Sheets

ELECTROPHOTOGRAPHIC COPYING MACHINE

BACKGROUND OF THE INVENTION

1. Field of the Invention

The present invention relates to an electrophotographic copying machine having a flash lamp for illuminating a document to be copied.

2. Description of the Prior Art

There is known an electrophotographic copying machine having a flash lamp for producing a flash of light to illuminate a document to be copied. The optical image of the illuminated document is focused onto a photosensitive body to form an electrostatic latent image thereon, which is thereafter developed into a visible image by an image developing device.

The flash lamp in such a copying machine may not be energized due to a malfunction, a failure, or a life termination of itself and/or a power supply circuit for the flash lamp. Since the flash lamp emits light through an electric discharge produced between electrodes, the flash lamp cannot be checked for a malfunction or a failure by way of a visual inspection which would be effective for a tungsten lamp, for example, having a tungsten filament which is heated for light emission. Furthermore, it is impossible for the operator to ascertain, from outside of the copying machine, whether light is being emitted from the flash lamp or not, because the copying machine is constructed not to allow light to leak out of the machine. Even when the operator finds the flash lamp inoperative during operation of the copying machine, several tens of copies that are fully black with toner will have been produced by that time because the copying machine with the flash lamp operates at high speed. Such fully black copies are problematic in that they are wasteful of toner and image transfer sheets, the toner is scattered around in the machine, and an image transfer sheet fully blackened with toner tends to be wound around an image fixing roller, causing a paper jam in the machine.

In conventional copying machines with flash lamps, a copy counter is not corrected when the flash lamp fails to be energized during machine operation. When the flash lamp is not energized during machine operation, the produced copy is fully blackened with toner and hence is not useful as a normal copy, but the copy counter counts it as a normal copy.

Some copying machines with a collating capability can copy a plurality of pages from each of a plurality of documents, sort and staple the copies into a plurality of sets of copies. Failure of the flash lamp in such a copying machine results in other drawbacks. For example, those copies which are fully black with toner have to be subsequently located and removed, and proper copies have to be produced again from corresponding pages and inserted into their positions in the proper sequence. Where many sets of copies are to be produced, the operator is required to find, if any, which set(s) and page(s) contain wrong copies resulting from a flash lamp failure.

SUMMARY OF THE INVENTION

It is an object of the present invention to provide an electrophotographic copying machine capable of preventing copies fully blackened with toner from being produced due to a flash lamp failure.

Another object of the present invention is to provide an electrophotographic copying machine capable of correcting a copy counter to provide a proper copy count when a flash lamp fails to be energized during operation of the copying machine.

Still another object of the present invention is to provide an electrophotographic copying machine which immediately interrupts the image developing process effected by an image developing device when a flash lamp fails to produce a flash of light.

A still further object of the present invention is to provide an electrophotographic copying machine which stops the feeding of documents when a flash lamp fails to be energized while the documents are being copied.

A yet still further object of the present invention is to provide an electrophotographic copying machine which can sort out copies blackened with toner due to a flash lamp failure from normal copies.

According to the present invention, there is provided an electrophotographic copying machine comprising a flash lamp for emitting a flash of light to illuminate a document thereby to produce an optical image of the document, a photosensitive body, means for focusing the optical image onto the photosensitive body to form an electrostatic latent image thereon, an image developing device for developing the electrostatic latent image into a visible image, an image transfer device for transferring the visible image onto an image transfer member, a sensor for detecting whether the flash lamp is energized, a detector circuit for producing a signal representative of whether the flash lamp is actually energized in response to a flash signal commanding energization of the flash lamp and a signal from the sensor at a time when the flash lamp is to be energized, means for effecting a predetermined operation when the flash lamp fails to be energized, and a control circuit responsive to the signal from the detector circuit, indicating that the flash lamp fails to be energized, for applying a signal to the effecting means.

The above arrangement can avoid an unnecessary consumption of toner, a contamination of components due to scattering toner, and a toner deposit and a paper jam in an image fixing device. When a copy fully blackened with toner is produced upon non-energization of a flash lamp, the count of a copy counter is automatically corrected to apprise the user of a correct count of produced copies. When the flash lamp is not energized, a document being copied is not fed. Heretofore, when a plurality of documents are successively copied and the flash lamp fails to emit light with respect to a particular document, it is necessary to copy such a document again and insert the produced copy into proper sequence after the other documents have been copied. The above problem is solved since the document is not fed upon failure of the flash lamp and is copied in a next copying cycle. Furthermore, the copy count can be automatically corrected and a wrong copy can be automtically discharged each time the flash lamp fails to be energized, so that it is not necessary for the operator to find, if any, which set(s) and page(s) contain wrong copies resulting from a flash lamp failure when a plurality of sets of copies are to be produced from a plurality of documents. This is also advantageous in that all copies delivered into a sorter are assumed to be good in quality.

The above and other objects, features and advantages of the present invention will become more apparent from the following description when taken in conjunction with the accompanying drawings in which preferred embodiments of the present invention are shown by way of illustrative example.

DETAILED DESCRIPTION

Figure 1:
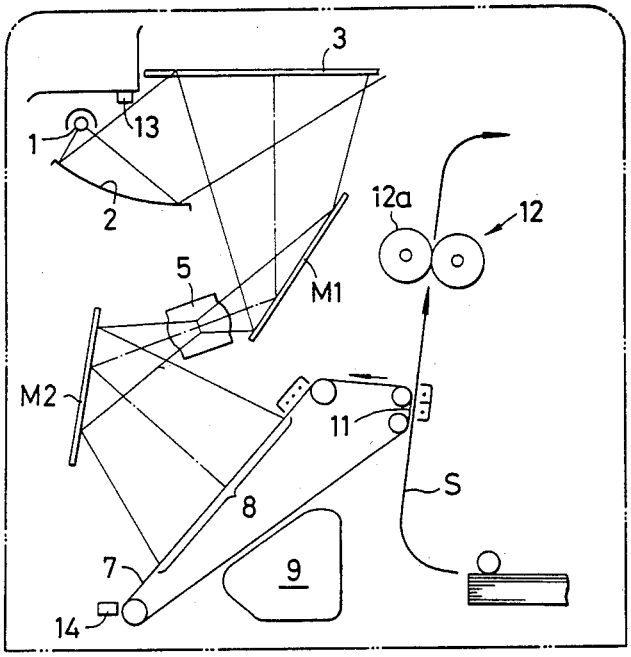
FIG. 1 is a schematic vertical cross-sectional view of an electrophotographic copying machine according to the present invention.

Like or corresponding parts are denoted by like or corresponding reference characters throughout several views.

FIG. 1 schematically shows an electrophotographic copying machine of the instantaneous full exposure type. When a flash lamp 1 is energized, it produces a flash of light that is reflected by a reflecting member 2 to illuminate a document (not shown) placed on a contact glass plate 3. The optical image of the illuminated document travels via a mirror M1, an image-formation lens 5, and a mirror M2, and is focused onto a photosensitive body 7 in the form of an endless belt at an exposure section. The focused optical image forms an electrostatic latent image on the photosensitive body 7, and the electrostatic latent image is then developed into a visible image by an image developing device 9.

The visible image on the photosensitive body 7 is thereafter transferred therefrom onto a precut image transfer sheet S of paper by an image transfer device 11. Then, the image transfer sheet S is delivered through an image fixing device 12 and discharged out of the copying machine.

In the event of a failure of the flash lamp 1 for some reason while the copying machine operates in a copying cycle, the document would not be illuminated with flash light and a copy fully blackened with toner would be produced. This would result in a wasteful consumption of toner and a contamination of some components in the machine due to scattering of toner. Such a fully black copy would tend to be wound around one of fixing rollers 12*a* of the image fixing device 12, causing a paper jam.

The electrophotographic copying machine shown in FIG. 1 is arranged to avoid the above problems as follows: A sensor 13 is disposed near the light path from the reflecting member 2 to the contact glass plate 3 for detecting whether the flash lamp 1 is energized or not. An erase lamp 14 is positioned between the exposure section 8 and the image developing device 9 in the path of travel of the visible image on the photosensitive body 7, the erase lamp 14 confronting the photosensitive body 7. The erase lamp 14 comprises an array of lamp elements such as light-emitting diodes which are arranged in a direction normal to the direction of travel of the photosensitive body 7, i.e., in the axial direction of rollers around which the photosensitive body 7 travels.

Figure 2:
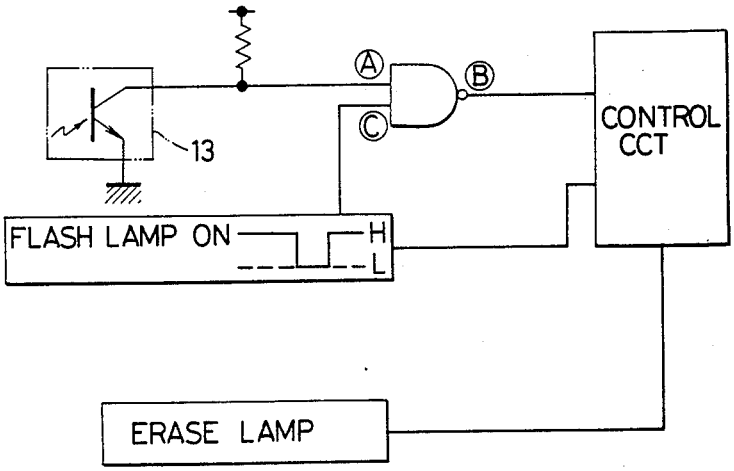
FIG. 2 is a block diagram of a control system for controlling the energization of an erase lamp.

FIG. 2 shows a control system for controlling energization of the erase lamp 14. It is assumed here that the flash lamp is energized for exposure when a flash signal is low. When the flash lamp is energized, an input terminal A of a NAND gate in FIG. 2 goes low. The low signal at the terminal A and the flash signal at an input terminal C of the NAND gate are NANDed to produce a high signal at an output terminal B. When the flash lamp is not energized, the input terminal A remains high, and hence the output terminal B also remains low. The low signal at the output terminal B is therefore representative of nonenergization of the flash lamp 1. A control circuit now applies a processing signal to the switch of the erase lamp 14 to energize the same. Thus, when the flash lamp 1 fails to be energized for some reason, the switch of the erase lamp 14, or a means for effecting a predetermined operation upon a failure of the flash lamp 1, is turned on by the control circuit to energize the erase lamp 14. At this time, all of the lamp elements of the erase lamp 14 are energized fully across the photosensitive body 7 and remain energized for a period of time during which the electrostatic latent image passes from end to end across the erase lamp 14.

By energizing the erase lamp 14 when the flash lamp 1 fails to emit light, no toner is applied by the image developing device 9 to the photosensitive body 7, and hence no wasteful consumption of toner results. Stated otherwise, a large amount of toner which would make a copy fully black is not consumed. Furthermore, components in the copying machine are prevented from being contaminated by toner that would be scattered around in the copying machine. An image transfer sheet fully blackened with toner would not be wound around the image fixing rollers 12*a*, and hence no paper jam would be caused.

The erase lamp 14 is located downstream of the exposure section 8 and upstream of the image developing device 9, i.e., between the exposure section 8 and the image developing device 9, in the direction of travel of the photosensitive body 7, so that the first image transfer sheet after the flash lamp 1 has failed to emit light can be prevented from being blackened with toner.

The flash lamp 1 may fail to emit light on account of a failure or malfunction of itself or and/or a power supply circuit for the flash lamp. Failures of the flash lamp due, for example, to leak-out of a filled gas and contact failure of a trigger electrode cannot easily be detected by way of a visual check since the flash lamp utilizes an electric discharge between electrodes unlike a tungsten lamp. Since the copying machine with the flash lamp operates at high speed, several copies or several tens of copies that are fully black with toner will have been produced by the time when the operator finds, if possible, the flash lamp inoperative during operation of the copying machine. It is impossible or extremely difficult for the operator to ascertain, from outside of the copying machine, whether light is being emitted from the flash lamp or not, because the copying machine is constructed to prevent light from leaking out and adversely affecting the operator.

In the embodiment shown in FIGS. 1 and 2, copies which are fully black with toner are automatically prevented from being produced without requiring the operator to confirm non-energization of the flash lamp. The sensor 13 for detecting whether the flash lamp is energized or not may comprise an optical sensor or an acoustic sensor capable of detecting sound produced by expansion of air around the flash lamp when the flash lamp emits light.

A copying machine generally has a copy counter such as an up counter or a down counter.

Figure 3:
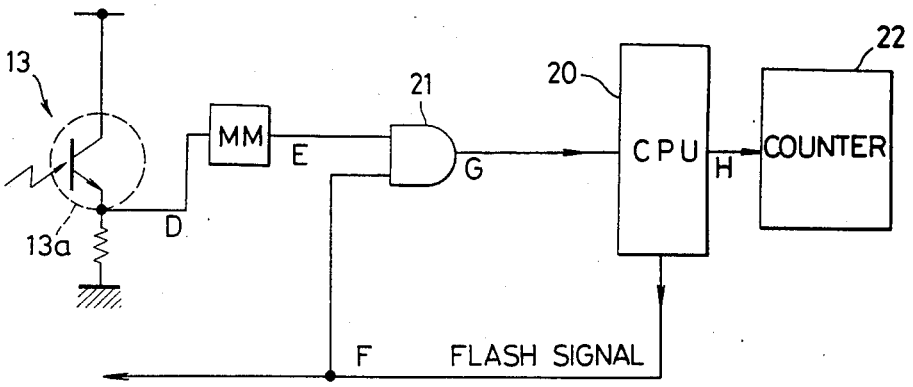
FIG. 3 is a block diagram of a control system according to the present invention.
Figure 4:
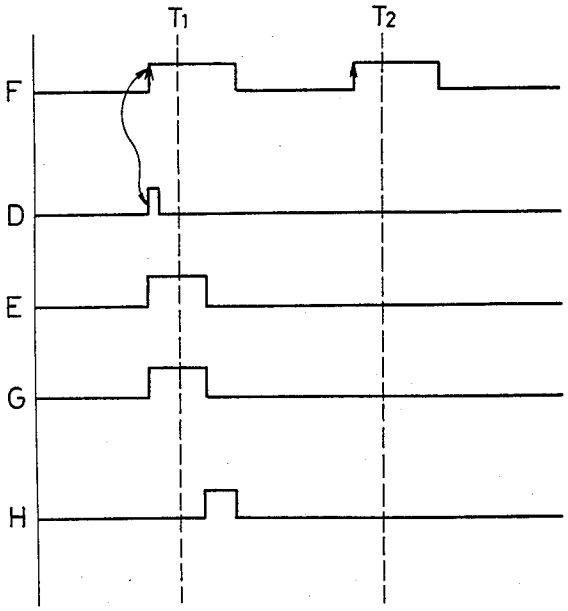
FIG. 4 is a timing chart of signals produced in the control system shown in FIG. 3.

FIG. 3 shows a control system according to another embodiment for detecting whether a flash lamp is energized or not to control a copy counter. FIG. 4 illustrates various signals generated in the control system. A photosensor 13 shown in FIG. 3 is disposed near the flash lamp 1 (FIG. 1) so as to be able to detect light emitted from the flash lamp 1. A control circuit 20 in the form of a CPU produces a flash signal F (FIG. 4) for turning on the flash lamp 1. A power supply unit for the flash lamp 1 is responsive to a positive-going edge of the flash signal F for triggering the flash lamp 1 to enable the latter to emit a flash of light. The light emitted from the flash lamp 1 is detected by the photosensor 13, whereupon a phototransistor 13*a* thereof is rendered conductive as indicated at D in FIG. 4. Since the light from the flash lamp 1 is instantaneous, it is delayed by a monostable multivibrator (one-shot multivibrator) to produce a signal E. The signal E and the flash signal F are ANDed by an AND gate 21 to generate a signal G. Energization and non-energization of the flash lamp 1 can be detected by detecting the signal G with the control circuit 20 at times T1, T2 (FIG. 4). The flash lamp 1 is energized at the time T1, and not energized at the time T2. The control circuit 20 issues a processing signal H for turning on and off a counter 22 in response to the signal G.

As shown in FIG. 4, when there is an output signal G from the AND gate 21, the control circuit 20 produces a processing or driving signal H for the counter 22. If the flash lamp 1 fails to emit light for some reason even when a flash signal F is applied, then a signal H is not generated by the control circuit 20. Therefore, the counter 22 is not driven or the count of the counter 22 is corrected. A total counter (not shown) is also controlled not to make one count. Then, a copy is produced once again to replace the preceding wrong copy that is fully black with toner.

The aforesaid automatic counter correction is highly effective since any fully blackened copies are automatically removed from the count of the counter 22.

Figure 5:
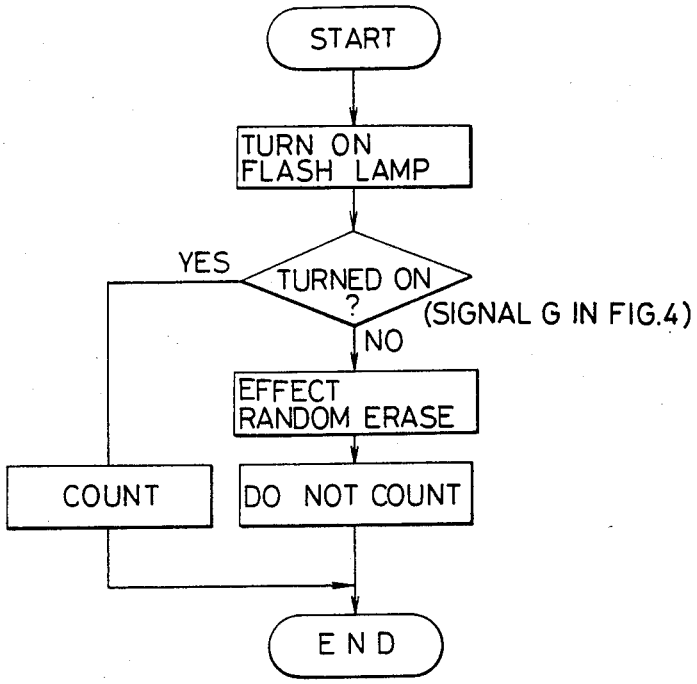
FIG. 5 is a flowchart of a control sequence according to the present invention.

FIG. 5 shows a flowchart of operation of the control system illustrated in FIG. 3. When the flash lamp fails to emit light, the elase lamp is supplied with a suitable signal to effect random erase on a non-illuminated segment of the photosensitive body for thereby forming a random pattern thereon, so that the operator can easily find the copy erroneous after it has been produced.

Figure 6:
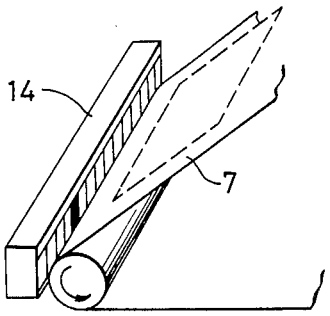
FIG. 6 is a perspective view of a mechanism for marking a wrong copy with an erase lamp.

FIG. 6 illustrates a mechanism for marking a copy with the erase lamp 14. When the flash lamp is not energized, one of the LEDs of the erase lamp 14 is not energized, and all other LEDs are energized to erase the latent image on the photosensitive body 7 while the latter is being continuously moved.

Figure 7:
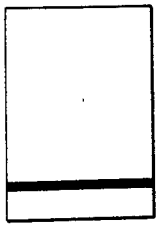
FIG. 7 is a plan view of a wrong copy marked by the mechanism shown in FIG. 6.

FIG. 7 shows a wrong copy which is marked with a single black stripe by operating the mechanism of FIG. 6 in the manner described above.

Figure 8:
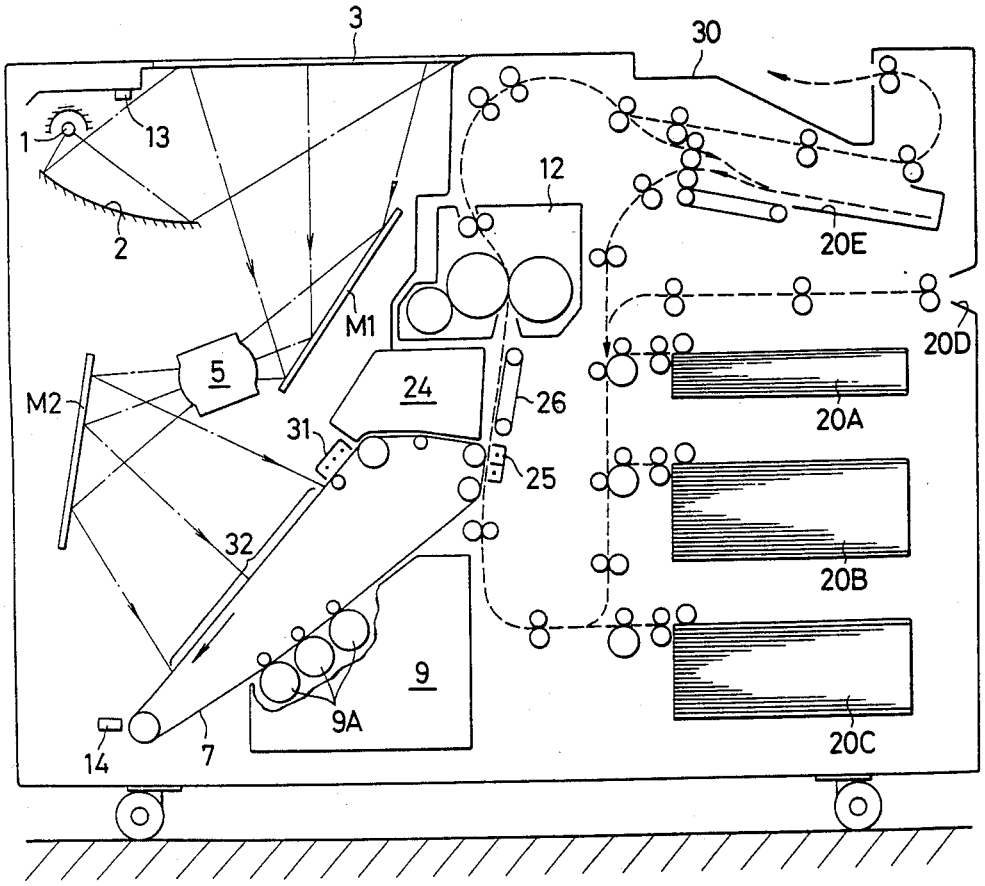
FIG. 8 is a schematic vertical cross-sectional view of an electrophotographic copying machine according to another embodiment of the present invention.

Another electrophotographic copying machine of the instantaneous full exposure type employing a flash lamp is illustrated in FIG. 8.

In FIG. 8, the photosensitive body 7 in the form of an endless belt is trained around rollers and travels in the direction of the arrow. The photosensitive body 30 is uniformly charged in a dark space by a charger 31 and is exposed to an optical document image at an exposure section 32 by a flash of light emitted by the flash lamp 1. More specifically, a document (not shown) placed on the contact glass plate 3 is illuminated with the flash light emitted from the flash lamp 1 and reflected by the reflecting member 2. The light reflected by the document then travels via the mirrors M1, M2 and the image-formation lens 5 onto the photosensitive body 7 to fully expose the same instantaneously at the exposure section 32.

The photosensitive body 7 with an electrostatic latent image thus formed thereon then passes under the erase lamp 14 which discharges an unwanted area of the photosensitive body 7. Thereafter, the photosensitive body 7 goes to the image developing device 9 in which the latent image is developed with toner into a visible image upon passage across image developing rollers 9A.

The visible toner image is then transferred by an image transfer device including an image transfer charger 25 from the photosensitive body 7 onto an image transfer sheet that has been fed from any one of sheet feeders 20A, 20B, 20C, or a manual sheet insertion slot 20D, or an intermediate sheet stocker 20E. Any residual toner on the photosensitive body 7 after the toner image has been transferred therefrom is removed by a cleaning device 24 to make the photosensitive body 7 ready for being charged for a next cycle of exposure.

The image transfer sheet onto which the toner image has been transferred is delivered by a belt 26 into an image fixing device 12 in which the toner image is fixed to the sheet, which is discharged into a tray 30. For copying images on both sides of the sheet, the sheet with an image copied on one side thereof is fed from the image fixing device 12 into the intermediate sheet stocker 20E, and delivered backwards therefrom toward the image transfer charger 25. In the image transfer charger 25, another image is copied on the other side of the sheet, which is eventually discharged into the tray 30. The sheet is delivered by feed rollers along paths indicated by the broken lines in FIG. 8.

The sensor or light detecting circuit 13 is disposed between the reflecting member 2 and the contact glass plate 3 and in the light path from the flash lamp 1 for detecting whether light has been emitted from the flash lamp 1 or not.

Figure 9:
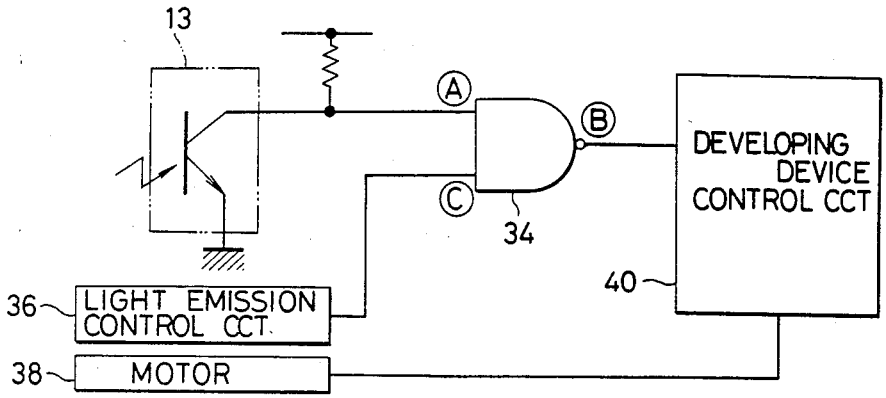
FIG. 9 is a block diagram of a control system for the copying machine shown in FIG. 8.
Figure 10:
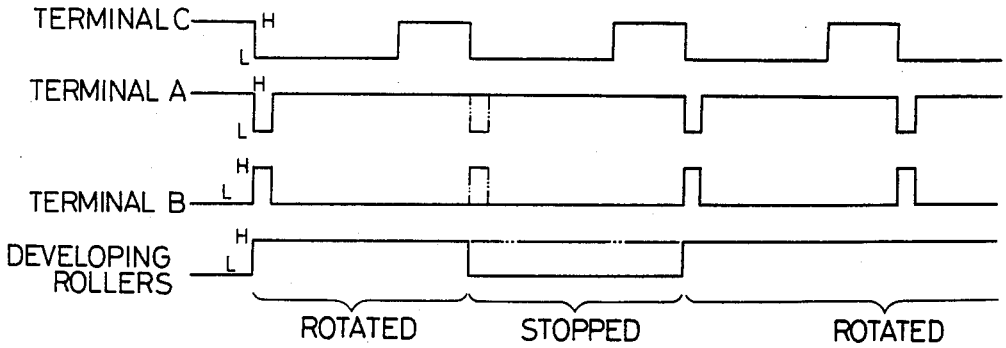
FIG. 10 is a timing chart showing operation of the control system illustrated in FIG. 9.

As shown in FIG. 9, the sensor 13 is connected to the input terminal A of a NAND gate 34. The sensor 13 produces a low-level signal only when the flash lamp 1 is energized to emit light, and generates a high-level signal otherwise, as shown in FIG. 10.

In FIG. 9, a light emission control circuit 36 produces a flash emission signal when the flash lamp 1 is to be energized according to a copying sequence of the copying machine. The flash emission signal from the light emission control circuit 36 is also applied to an input terminal C of the NAND gate 34. As shown in FIG. 10, the output or flash emission signal from the light emission control circuit 36 goes from the high level to the low level for energizing the flash lamp 1 to emit light. Therefore, the NAND gate 34 produces a high-level signal at its output terminal B only when there is a flash emission signal from the light emission control circuit 36 and the sensor 13 detects emitted light. When no light is detected by the sensor 13 irrespective of a flash emission signal from the light emission control circuit 36, i.e., when no light is emitted by the flash lamp 1, the output signal from the NAND gate 34 remains low.

The output terminal B of the NAND gate 34 is connected to a developing device control circuit 40 which controls rotation of a motor 38 that drives the image developing rollers 19A, i.e., operation of the image developing device 9. The developing device control circuit 40 rotates the motor 38 only when the output signal from the NAND gate 34 is high.

Therefore, when there is a flash emission signal from the light emission control circuit 36 to make the terminal C low and the flash flamp 1 is energized to make the terminal A low, the terminal B goes high to rotate the motor 38. However, if there is no flash of light emitted from the flash lamp 1 even in the presence of a flash emission signal from the light emission control circuit 36, then the terminal A remains high, and the developing rollers 19A are not rotated. Therefore, the image developing device 9 remains inoperative. Indicated by the imaginary lines in FIG. 10 are output signals which would be produced if the flash lamp were energized normally.

With the above arrangement for shutting off the image developing device being combined with the copying machine, the developing rollers 19A are stopped in a copying cycle in which the flash lamp 1 fails to emit flash light while the copying machine is operating in a succession of copying cycles. Therefore, when the flash lamp 1 fails, no developing operation is carried out, and no copy blackened with toner is produced.

While in the embodiment shown in FIGS. 8 through 10 the image developing device is shut off by stopping the rotation of the developing rollers, it may be shut off to stop image development by any other suitable means such as control of an image developing bias.

Figure 11:
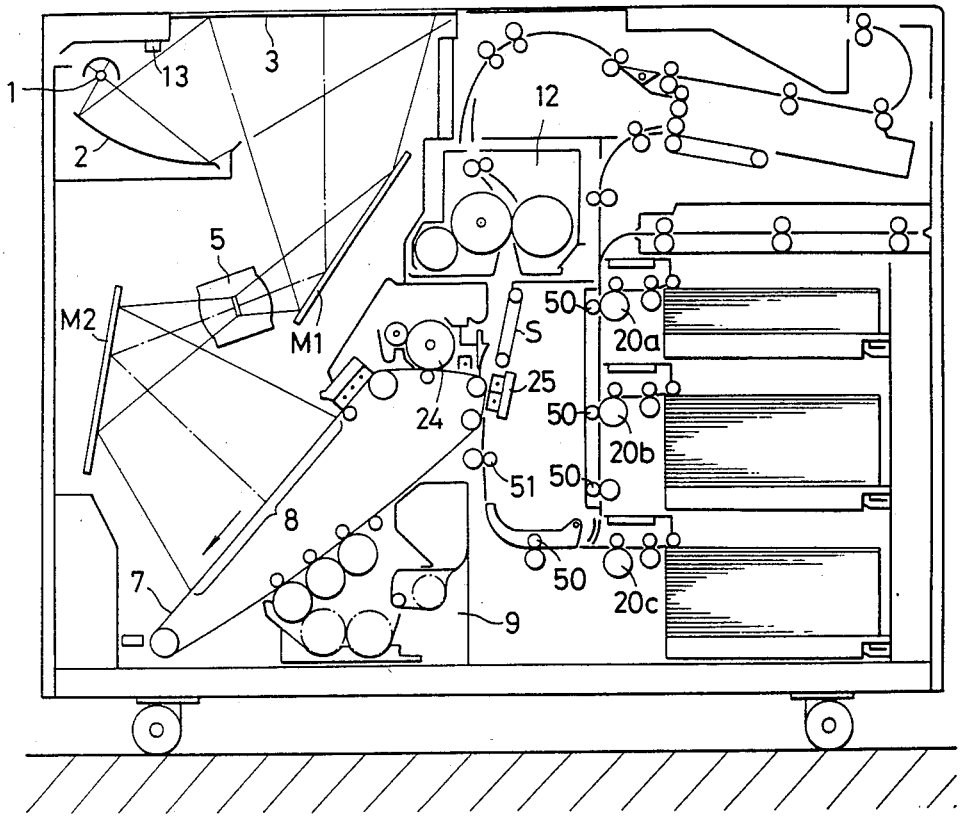
FIG. 11 is a schematic vertical cross-sectional view of an electrophotographic copying machine according to still another embodiment of the present invention.

FIG. 11 shows an electrophotographic copying machine of the instantaneous full exposure type according to still another embodiment of the present invention. In FIG. 11, when the switch of the flash lamp 1 is turned on, a document (not shown) placed on the contact glass plate 3 is fully illuminated with the flash light emitted from the flash lamp 1 and reflected by the reflecting member 2. The light reflected by the document then travels via the mirrors M1, M2 and the image-formation lens 5 onto the photosensitive body 7 to fully expose the same instantaneously at the exposure section 8 to form an electrostatic latent image thus on the body 7. Thereafter, the latent image is developed with toner into a visible image by the image developing device 9. The visible toner image is then transferred by the image transfer charger 25 from the photosensitive body 7 onto an image transfer sheet S that has been fed from any one of sheet feeders through one of sheet feed rollers 20*a*, 20*b*, 20*c*, one of a delivery rollers 30, and a resistance roller 51. Thereafter, the image transfer sheet is separated from the photosensitive body 7, and the transferred image is fixed by the image fixing device 12 to the image transfer sheet, which is discharged out of the copying machine. Any residual toner on the photosensitive body 7 is removed by the cleaning device 24 for reuse.

The copying machine shown in FIG. 11 additionally has a means for preventing a visible toner image from being transferred from the photosensitive body 7 onto the image transfer sheet S when no flash light is detected after the switch of the flash lamp 1 has been turned on.

More specifically, the sensor 13 in the form of a photoelectric sensor is positioned in the light path from the reflecting member 2 to the contact glass plate 3 for detecting whether there is a flash of light emitted from the flash lamp 1.

Figure 12:
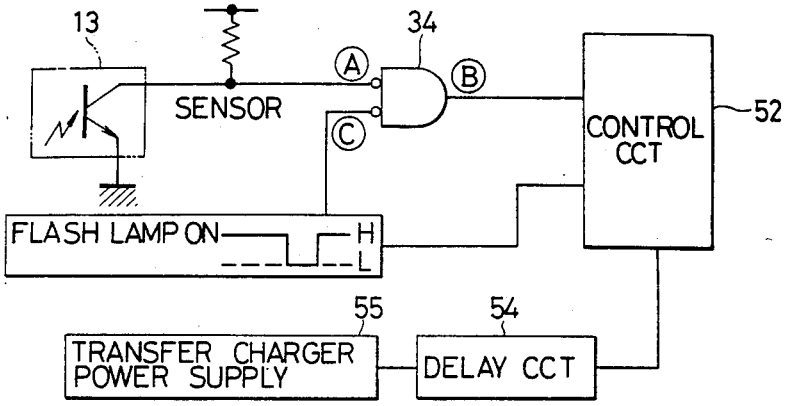
FIG. 12 is a block diagram of a control system for the copying machine shown in FIG. 11.

FIG. 12 shows in block form a control system for controlling image transfer from the photosensitive body 7 onto the image transfer sheet S. A signal for energizing the flash lamp 1 and a signal from the sensor 13 are applied respectively to the input terminals C, A of the NAND gate 34, with its output terminal B coupled to a control circuit 52. The flash lamp 1 is energized when the signal for energizing the flash lamp 1 goes low.

Normally, the flash lamp 1 is turned on and the sensor 13 detects light emitted from the flash lamp 1, whereupon the input terminal A of the NAND gate 34 goes low. Since the signal for energizing the flash lamp 1 is low and applied to the input terminal C of the NAND gate 34, the output terminal B issues a high-level signal. However, if the flash lamp 1 fails to emit light notwithstanding the switch thereof is turned on, the input terminal A remains high, and the output terminal B remains low. Thus, the control circuit 52 now determines that flash lamp 1 has failed to emit light. After a period of time in which the leading end of an image-forming segment of the photosensitive body 7 arrives at the image transfer position has elapsed in a delay circuit 54, a power supply 55 of the image transfer charger 25 is controlled by the control circuit 52 to cut off a corona discharge. As a result, the toner attracted by the image developing device 9 to the photosensitive body 7 over the entire surface of the image-forming segment due to the failure of the flash lamp 1 will not be transferred onto the image transfer sheet S. The toner is cleaned away by the cleaning device 24 and will be reused without wasteful consumption.

Inasmuch as the image transfer sheet S is blackened with toner, the image transfer sheet S can smoothly be passed through the image fixing device 12 without causing a paper jam which would arise from the sticky nature of the toner.

Figure 14:
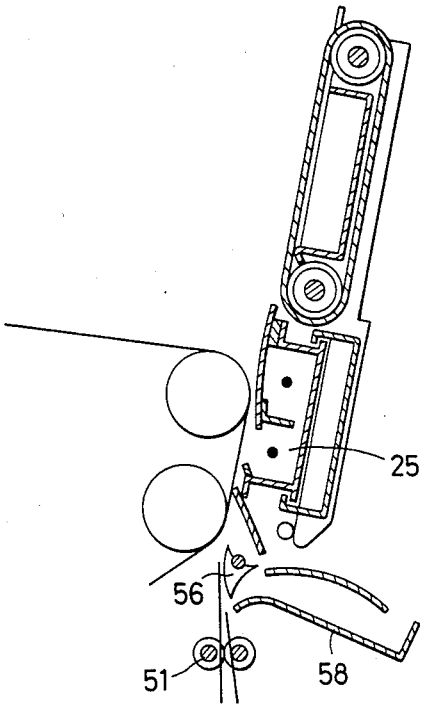
FIGS. 14 and 15 are vertical cross-sectional views of a separator device according to another embodiment.
Figure 15:
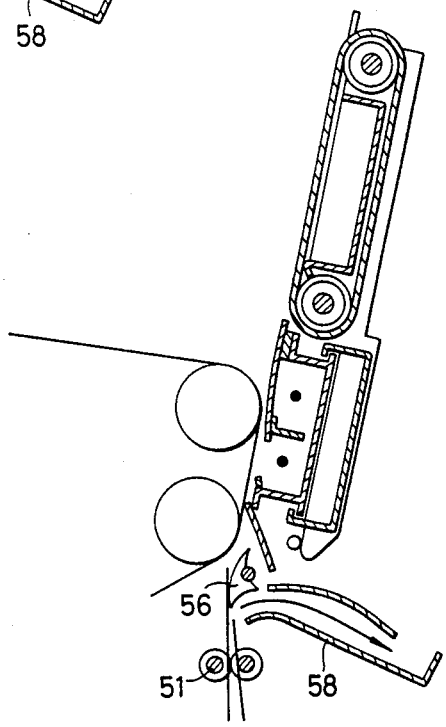

Another means for preventing toner from being transferred from the photosensitive body 7 onto the image transfer sheet S will be described below. As shown in FIG. 14, a pivotally movable separator finger 56 is disposed in the sheet feed path between the resistance roller 51 and the image transfer charger 25. When the switch of the flash lamp 1 is turned on, but the flash lamp 1 fails to emit light, the separator finger 56 is angularly moved by the control circuit 52 (FIG. 12) to the position of FIG. 15 for discharging the image transfer sheet into a tray 58 without delivering the sheet into the image transfer charger 25. When the flash lamp 1 returns to its normal position, the separator finger 56 is shifted back to the position of FIG. 14.

Alternatively, when the flash lamp 1 fails, the feed rollers 20*a*, 20*b*, 20*c*, the delivery rollers 50, and the resistance roller 51 may be stopped to prevent an image transfer sheet from being fed to a photosensitive body segment to which no flash light has been applied.

As another alternative, a shutter may be provided to cover the image transfer charger 25 for preventing a corona discharge from being produced while the image-forming segement of the photosensitive body is passing across the image transfer charger 25 when the flash lamp 25 fails.

Should the flash lamp 1 fails in successive copying cycles, it is better not only to control the image transfer operation, but to stop the entire operation of the copying machine. If the flash lamp 1 undergoes successive failures, e.g., if the flash lamp 1 fails to emit light in two consecutive cycles, or three times in one hundred copying cycles, then the copying machine may be stopped in the ordinary stop mode and a lamp failure may be indicated on an indicator.

Figure 13:
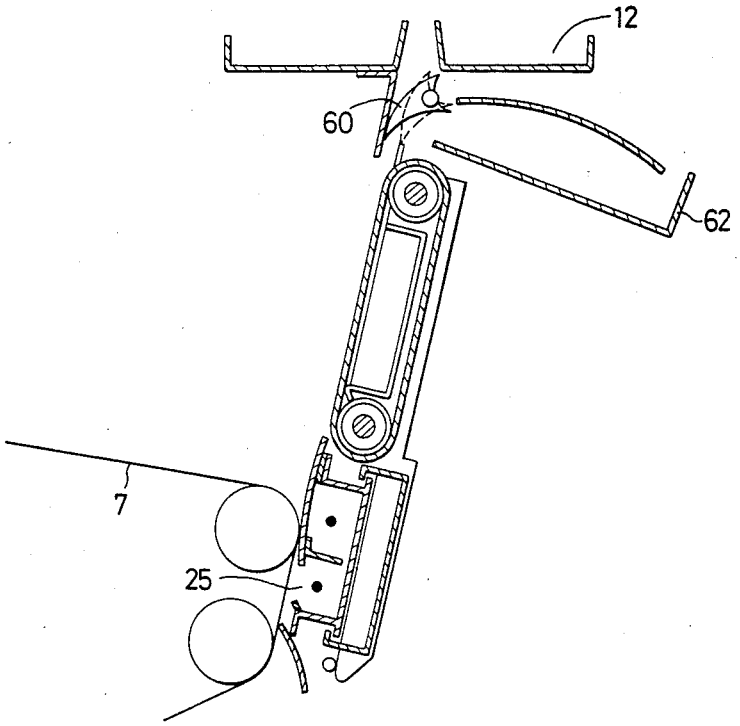
FIG. 13 is a vertical cross-sectional view of a separator device for separating an image transfer sheet to which no image has been transferred.

The image transfer sheet with no toner image transferred thereto under the image transfer control described above may be discharged by a separator finger 60 (FIG. 13) into a non-transfer-sheet tray 62, so that the image transfer sheet with no toner image can be discriminated from normally copied sheets. The separator finger 60 is positioned upstream of the image transfer charger 12 and is switched over upon elapse of a time in which the sheet travels from the image transfer charger 25 to the separator finger 60 after the leading end of the sheet has left the image transfer charger 25. The separator finger 60 is moved back to the initial position when the flash lamp is normalized.

Figure 16:
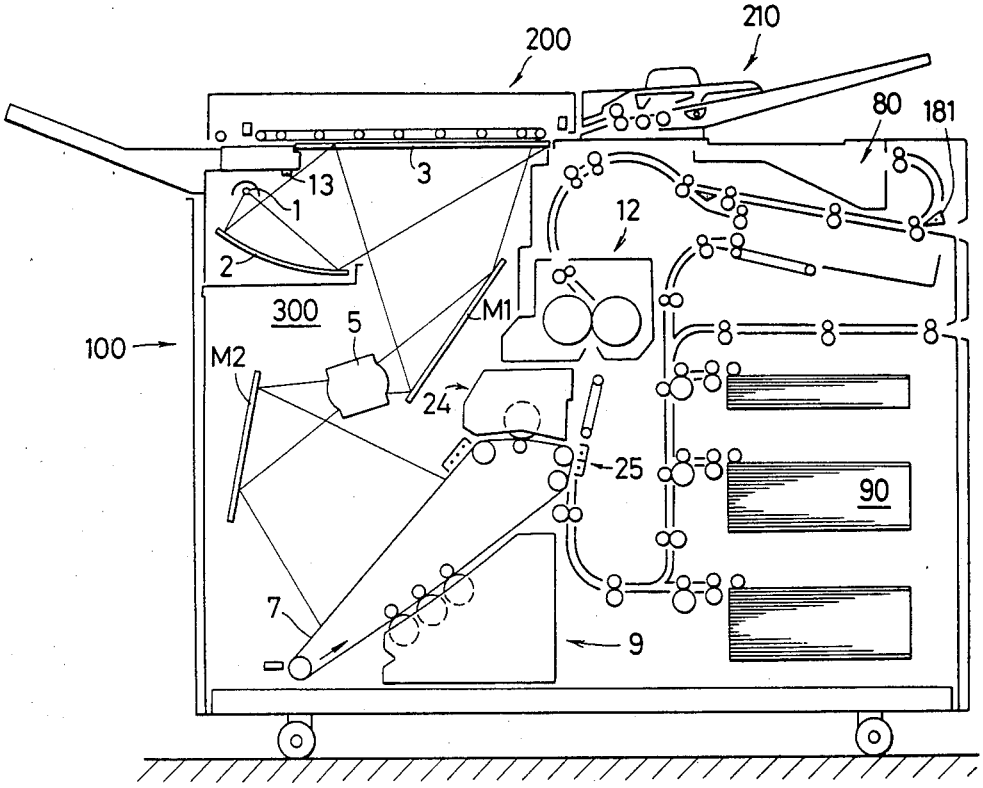
FIG. 16 s a schematic vertical cross-sectional view of an electrophotographic copying machine according to a still further embodiment of the present invention.

FIG. 16 illustrates an electrophotographic copying machine of the instantaneous full exposure type according to a still further embodiment of the present invention. The electrophotographic copying machine, generally designated at 100, includes a document feeder 200 positioned in its upper portion and an exposure means 300 disposed below the document feeder 200. The image developing device 9, the image transfer charger 25, the cleaning device 24, and the image fixing device 12 are disposed substantially centrally in the copying machine in upwardly spaced successive positions, respectively. A discharge tray 80 for receiving discharged copies and cassettes 90 for storing image transfer sheets are positioned in the righthand side of the copying machine. When a copying button (not shown) is depressed, the document feeder 200 is actuated to feed a document from a document tray 210 onto the contact glass plate 3. Then, the flash lamp 1 is instantaneously energized to emit a flash of light, which is reflected by the reflecting member 2 to illuminate the document. The optical document image is focused on the photosensitive body 7 through the mirrors M1, M2 and the image-formation lens 5 to form an electrostatic latent image, which is developed by the image developing device 9 into a visible toner image. The visible toner image is thereafter transferred by the image transfer charger 25 onto an image transfer sheet fed from one of the cassettes 10. The image transfer sheet with the toner image thereon travels through the image fixing device 12 and is discharged as a copy into the discharge tray 80.

If the flash lamp 1 fails to emit light for some reason while the copying machine is in a succession of copying cycles, the document is not illuminated, and a fully black copy would be produced. To avoid this problem, a detector circuit is provided for detecting energization of the flash lamp, and an output signal from the detector circuit is applied to an automatic feed control circuit, which feeds a document when the output signal indicates energization of the flash lamp and does not feed a document when the output signal indicates non-energization of the flash lamp.

Figure 17:
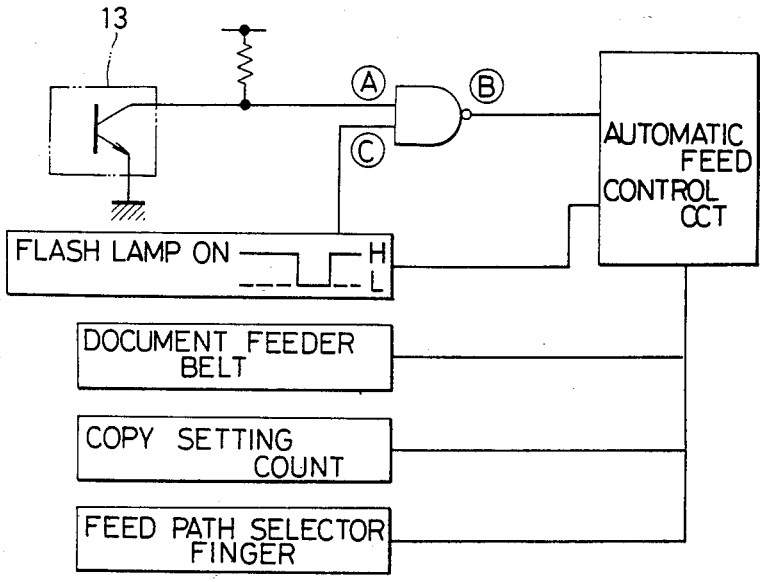
FIG. 17 is a block diagram of a control system for the copying machine shown in FIG. 16.

More specifically, as shown in FIGS. 16 and 17, the sensor 13 disposed in the light path from the reflecting member 2 to the contact glass plate 3 and the NAND gate constitute a detector circuit coupled to an automatic feed control circuit. The sensor 3 may be an optical sensor or an acoustic sensor. The automatic feed control circuit produces a command signal for driving or stopping a feed belt in the document feeder 200. The flash lamp 1 is turned on when the signal for energizing the flash lamp is low as shown in FIG. 17. When the flash lamp 1 is turned on, the input terminal A goes low. The signals applied to the input terminals A, B are NANDed by the NAND gate, which produces a high output signal from its output terminal B. The automatic feed control circuit now drives the document feeder belt in the document feeder 200. When the flash lamp 1 fails to be turned on, the input terminal A remains high, and hence the output terminal B remains low. The automatic feed control circuit therefore stops the document feeder belt.

The copying machine also includes a separator finger 181 (FIG. 16) for changing sheet feed paths. When a signal indicative of a flash lamp failure is applied from the NAND gate to the automatic feed control circuit, the automatic feed control circuit controls a copy count setting so that a wrong copy produced due to a flash lamp failure will be excluded from the copy count setting (in a manner similar to that described with reference to FIGS. 3 and 4), and also controls the separator finger 181 so that an image transfer sheet from the image fixing device 12 will be moved upwardly into the discharge tray 80. Therefore, even if a wrong copy is produced due to a flash lamp failure while a plurality of copies are being produced from each of a plurality of documents, such a wrong copy is automatically discharged out of the copying machine, and copies are produced in a sorter (not shown) in a proper sequence according to the copy count setting.

Although certain preferred embodiments have been shown and described, it should be understood that many changes and modifications may be made therein without departing from the scope of the appended claims.

We claim:

1. A.n electrophotographic copy machine comprising:

a flash lamp for emitting a flash of light to illuminate a document thereby to produce an optical image of the document;

a power supply circuit for supplying power to said flash lamp;

a photosensitive body;

means for focusing said optical image onto said photosensitive photosensitive body to form an electrostatic latent image thereon;

an image developing device for developing said electrostatic latent image into a visible image;

an image transfer device for transferring said visible image onto an image transfer member;

a sensor for detecting whether said flash lamp is energized;

a detector circuit for producing a signal representative of whether said flash lamp is actually energized in response to a flash signal commanding energization of said flash lamp and a signal from said sensor at a time when said flash lamp is to be energized;

means for effecting a predetermined operation when said flash lamp fails to be energized; and a control circuit responsive to the signal from said detector circuit, indicating that said flash lamp fails to be energized, for applying a signal to said effecting means;

a processing unit for performing a process required to achieve normal copying operation, said effecting means preventing said process from being performed, said processing unit comprising a feed path for passage of the image transfer member therealong, and further including a sheet path selecting means for directing the image transfer member selectively toward a discharge tray and a sorter, said effecting means comprising means for controlling said sheet path selecting means.

2. An electrophotographic copying machine according to claim 1, wherein said image transfer member is a precut sheet of paper.

3. An electrophotographic copying machine according to claim 1, wherein said sensor comprises an acoustic sensor for detecting sound produced by expansion of air around said flash lamp upon energization thereof.

4. An electrophotographic copying machine according to claim 1, wherein said sensor comprises an optical sensor for detecting the flash of light emitted by said flash lamp.

5. An electrophotographic copying machine according to claim 1, further including a contact glass plate for supporting the document thereon, and a reflecting member for reflecting the flash of light toward the document on said contact glass plate, said sensor being disposed in a light path extending from said reflecting member to said contact glass plate.

6. An electrophotographic copying machine according to claim 1, wherein said photosensitive body comprises a rotatable endless belt with an exposure section in which said optical image is focused onto said endless belt.

7. An electrophotographic copying machine according to claim 1, wherein said processing unit comprises a copy counter for counting produced copies, said effecting means comprises control means for controlling the operation of said copy counter, and said signal to be applied to said effecting means is a signal for commanding stoppage of a counting cycle of said copy counter.

8. An electrophotographic copying machine according to claim 1, further comprising an erase lamp for emitting light to erase an electrostatic latent image from said photosensitive body, said effecting means comprises a switch of said erase lamp, said photosensitive body being rotatable, said erase lamp extending in a direction normal to the direction in which said photosensitive body is rotatable, and said erase lamp including an array of selectively energizable lamp elements.

9. An electrophotographic copying machine according to claim 8, wherein said signal to be applied to said effecting means is a signal for commanding energization of said erase lamp.

10. An electrophotographic copying machine according to claim 1, wherein said detector circuit comprises a NAND gate for producing a high-level output signal when said flash signal is low in level at the time of commanding energization of said flash lamp and said signal of said sensor is low in level upon detection of energization of said flash lamp.

11. An electrophotographic copying machine according to claim 1, wherein said detector circuit comprises an AND gate for producing a high-level output signal when said flash signal is high in level at the time of commanding energization of said flash lamp and said signal of said sensor is high in level upon detection of energization of said flash lamp.

12. An electrophotographic copying machine according to claim 10, wherein said processing unit comprises said image developing device, said image developing device including at least one image developing roller and a motor for driving said image developing roller, said effecting means comprising control means for stopping rotation of said motor.

13. An electrophotographic copying machine according to claim 10, wherein said processing unit comprises said image developing device, and said effecting means comprises control means for controlling a developing bias of said image developing device.

14. An electrophotographic copying machine according to claim 10, wherein said processing unit comprises said image transfer device, said image transfer device including an image transfer charger, said effecting means comprising means for turning on and off a power supply for producing a corona discharge in said image transfer charger.

15. An electrophotographic copying machine according to claim 10, wherein said processing unit comprises said image transfer device, said image transfer device including an image transfer charger and a shutter for covering said image transfer charger while the image transfer member passes through said image transfer device, said effecting means comprising means for controlling said shutter.

16. An electrophotographic copying machine according to claim 9, wherein said processing unit comprises an entire copying machine assembly, and said effecting means comprises a main switch of said copying machine assembly.

17. An electrophotographic copying machine according to claim 10, wherein said processing unit comprises an automatic document feeder including a document feeder belt, and said effecting means comprises means for stopping operation of said document feeder belt.

18. An electrophotographic copying machine according to claim 7, wherein said copy counter is an up counter.

19. An electrophotographic copying machine according to claim 7, wherein said copy counter is a down counter.

20. An electrophotographic copying machine comprising:

a flash lamp for emitting a flash of light to illuminate a document thereby to produce an optical image of the document;

a power supply circuit for supplying power to said flash lamp;

a photosensitive body;

means for focusing said optical image onto said photosensitive body to form an electrostatic latent image thereon;

an image developing device for developing said electrostatic latent image into a visible image;

an image transfer device for transferring said visible image onto an image transfer member;

a sensor for detecting whether said flash lamp is energized;

a detector circuit for producing a signal representative of whether said flash lamp is actually energized in response to a flash signal commanding energization of said flash lamp and a signal from said sensor at a time when said flash lamp is to be energized;

means for effecting a predetermined operation when said flash lamp fails to be energized; and a control circuit responsive to the signal from said detector circuit, indicating that said flash lamp fails to be energized, for applying a signal to said effecting means;

a processing unit for performing a process required to achieve normal copying operation, said effecting means preventing said process from being performed, said processing unit comprising a feed path for passage of the image transfer member therealong, and further including a feed roller, a delivery roller, and a resistance roller for feeding said image transfer member, said effecting means comprising means for stopping rotation of said rollers.

* * * * *